United States Patent [19]

Russell

[11] 3,997,216

[45] Dec. 14, 1976

[54] APPARATUS FOR CONTINUOUS MINING

[76] Inventor: John D. Russell, R.D. No. 1, Portersville, Pa. 16051

[22] Filed: Oct. 21, 1971

[21] Appl. No.: 191,387

[52] U.S. Cl. ..... 299/57; 198/513; 198/610; 198/812; 299/19; 299/33

[51] Int. Cl.[2] ..... E21C 1/00; B65G 65/06

[58] Field of Search ..... 198/7 R, 9, 36, 109, 198/139, 159, 188, 182, 104, 229, 238, 203, 208; 299/10, 56, 64, 67, 33, 59, 19; 37/117.5

[56] References Cited

UNITED STATES PATENTS

| | | | |
|---|---|---|---|
| 1,882,629 | 10/1932 | James | 198/9 |
| 1,977,147 | 10/1934 | Rogers et al. | 198/159 |
| 2,413,339 | 12/1946 | Stadelman | 198/182 |
| 2,579,562 | 12/1951 | Fruechtel | 198/159 |
| 2,744,607 | 5/1956 | Russell | 198/9 |
| 2,827,274 | 3/1958 | Poundstone | 299/33 |
| 2,846,051 | 8/1958 | Craggs et al. | 198/139 |
| 3,043,035 | 7/1962 | Fogelberg | 198/9 |
| 3,333,898 | 8/1967 | Russell | 299/18 |
| 3,349,892 | 10/1967 | Barre | 198/9 |
| 3,533,660 | 10/1970 | Russell | 299/18 |

FOREIGN PATENTS OR APPLICATIONS

| | | | |
|---|---|---|---|
| 1,158,143 | 6/1958 | France | 37/117.5 |

*Primary Examiner*—James B. Marbert
*Assistant Examiner*—Joseph E. Valenza
*Attorney, Agent, or Firm*—Carothers and Carothers

[57] ABSTRACT

Material is continuously dislodged by a pair of conical cutters and displaced outwardly toward the ribs of the room as the mining machine advances. The dislodged material is picked up by a transversely extending spiral conveyor and conveyed inwardly from the ribs onto the bottom strand of a flexible belt. The flexible belt has one end portion coiled on a lower rotatable spindle at a fixed discharge station adjacent the room entry. The other end portion of the flexible belt is coiled on an upper rotatable spindle positioned above the lower rotatable spindle. The intermediate portion of the flexible belt forms a lower conveying strand portion extending from the lower coil around a cylindrical idler or turn around pulley and an upper strand portion extending from the upper spindle to the turn around pulley. The upper strand portion extends between a pair of driven compression rollers to pull the upper strand toward the mining machine from the upper spindle.

11 Claims, 6 Drawing Figures

APPARATUS FOR CONTINUOUS MINING

CROSS-REFERENCES TO RELATED APPLICATIONS

Co-pending applications by the same inventor and assigned to the same assignee are directed to a flexible belt type of conveying mechanism entitled "Method and Apparatus For Conveying Material" patent application Ser. No. 191,174 filed Oct. 21, 1971 now Pat. No. 3,796,298.

BACKGROUND OF THE INVENTION

1.Field of the Invention This invention relates to method and apparatus for continuously mining and conveying material from the advancing mining machine to a fixed discharged station and particularly to a method and apparatus for conveying material from a continuously advancing mining machine by conveying the material transversely by a conveyor associated with the mining machine onto a flexible belt that is coiled and uncoiled on a pair of spindles located adjacent a fixed discharge station.

2. Description of the Prior Art

The use of spooled ribbon type extensible support for endless flexible belting is known and is disclosed in U.S. Pat. No. 2,774,462. With the arrangement disclosed in this U.S. patent, the extensibiliy of the conveyor belt is limited by the length of the endless flexible conveyor belt supported on the coiled extensible support.

In U.S. Pat. No. 3,553,660 there is illustrated conveying apparatus for transporting dislodged material from a continuously advancing mining machine to a fixed discharge station. A flexible belt has one end coiled on a spindle mounted on the mining machine and the other end coiled on a spindle mounted adjacent the fixed discharge station. The dislodged material is deposited on the upper surface of the flexible belt adjacent the first spindle and the flexible belt is coiled about the second spindle adjacent the fixed discharge station to move successive sections of the flexible belting from the continuous mining machine to the fixed discharge station. Periodically, the flexible belt is uncoiled from the spindle adjacent the fixed discharge station and coiled on the first spindle mounted on the mining machine. The first spindle mounted on the mining machine limits substantially the size of the coil of flexible belting that can be wound on the spindle mounted on the mining machine. Further, a substantial period of time is required to uncoil the belting from the spindle adjacent the discharge station and again coil the flexible belting on the spindle mounted on the mining machine.

SUMMARY OF THE INVENTION

The hereinafter described invention is directed to a method and apparatus for continuously mining and includes dislodging material from a mine face by a pair of counter-rotating cutter heads and depositing the material adjacent the rib. The dislodged material is thereafter conveyed inwardly from the ribs by a transverse conveyor associated with the mining machine onto the lowe strand of a flexible belt conveyor. The flexible belt conveyor has one end portion coiled on a lower spindle located adjacent a fixed discharge station. The other end portion of the conveyor is coiled on an upper spindle located adjacent to the fixed discharge station. The flexible belt has an intermediate or loop portion reeved about a turn around means on the mining machine to form a lower strand portion and an upper strand portion. The dislodged material conveyed transversely by the conveyor associated with the mining machine is deposited on the lower conveying strand of the flexible belt adjacent the mining machine. Motor means associated with the lower spindle rotate the lower spindle to coil the flexible belt thereon and convey the dislodged material on the lower strand from the mining machine to the discharge station at the lower strand slides along the mine floor. The upper strand is positioned between a pair of driven pinch rolls mounted on the mining machine. The pinch rolls pull the upper strand and uncoil on the upper spindle as the mining machine advances and feeds the upper strand around the turn around means to form the lower conveying strand. A second coil of flexible belt may be positioned on the upper spindle after the first flexible belt is uncoiled therefrom. The free end portion of the second flexible belt is connected to the free end portion of the first flexible belt to provide additional belting for conveying the dislodged material from the mining machine to the discharge station. The first flexible belt when completely uncoiled on the lower spindle may be disconnected from the second belt and removed therefrom as a coil to be positioned on the second spindle when the second flexible belt is uncoiled therefrom.

With the above arrangement, material dislodged by the counter-rotating cutter heads of the mining machine is deposited adjacent the ribs of he room or entry and thereafter conveyed transversely away from the ribs by a conveyor associated with the mining machine. The dislodged material conveyed by the transverse conveyor is deposited on the bottom strand of a flexible belt that slides along the floor of the room as it is coiled on a spindle located adjacent the discharge station. The upper strand of the flexible conveyor belt is uncoiled from an upper spindle by a pair of driven pinch rolls mounted on the mining machine. With this apparatus material is continuously dislodged from the face and continuously conveyed to a fixed discharge station spaced from the mining machine.

Accordingly, the principal object of this invention is to provide a method and apparatus for continuously dislodging material and transporting the dislodged material to a fixed discharge station.

Another object of this invention is to provide a method and apparatus for eliminating a portion of the tensile stress exerted on a flexible belt conveyor.

These and other objects and advantages of this invention will be more completely disclosed and described in the following specification, the accompanying drawings and the appended claims.

BRIEF DESCRIPTION OF THE DRAWINGS

FIG. 1 illustrates the continuous mining machine adjacent the discharge station with substantially all of the flexible belt coiled about the upper spindle.

DESCRIPTION OF THE PREFERRED EMBODIMENTS

Figure 3:
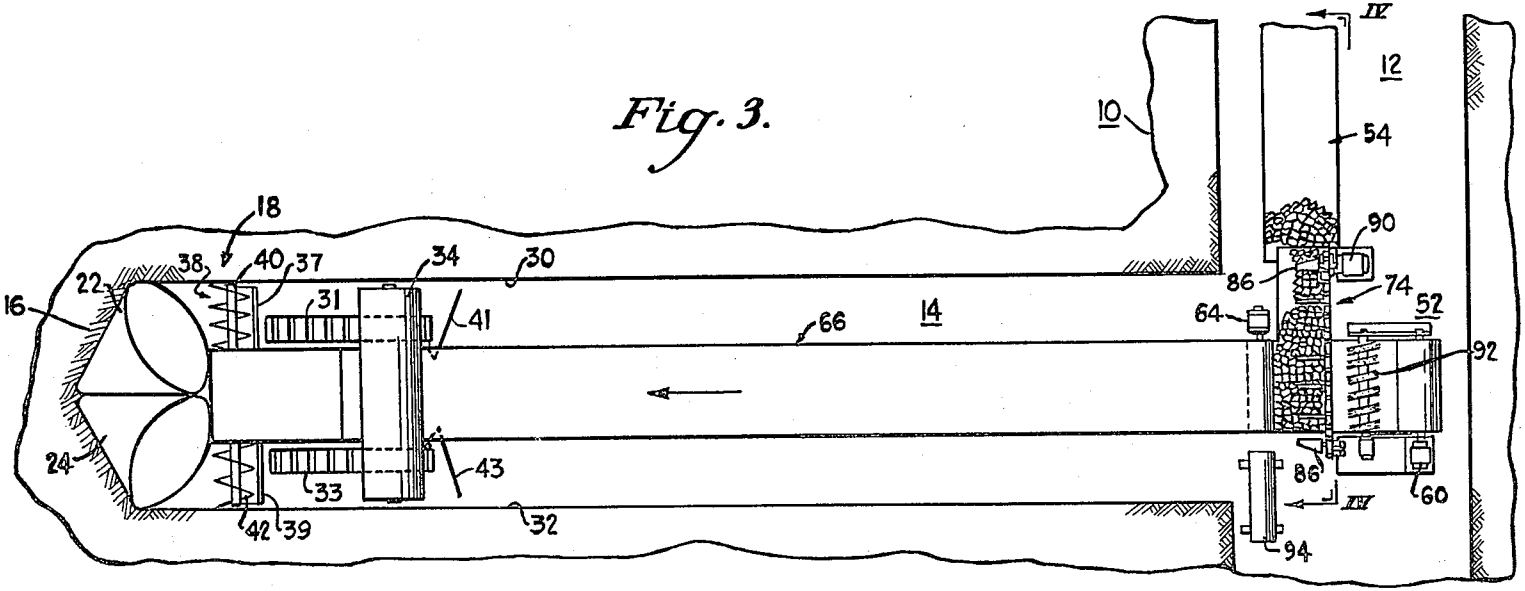
FIG. 3 is a top plan view of the mining machine and flexible belt conveyor apparatus illustrated in FIG. 2.

Referring to the drawings, there is illustrated schematically an underground mine generally designated by the numeral 10 that includes an entry or haulage way 12 with transversely extending rooms 14. The room 14 is relatively narrow and has a transverse dimension substantially equal to the transverse dimension of the mining machine. The room 14 is formed by dislodging material from the mine face 16 by a mining machine generally designated by the numeral 18.

As schematically illustrated in the drawings, the mining machine 18 has a body portion or frame 20 on which there are mounted a pair of forwardly extending conical cutter heads 22 and 24 and an upper cylindrical top cutter 26 that extends transversely across the room 14. The top cutter may be adjustable vertically to control the height of the room. The body portion 20 has a plow shaped forwardly extending apron 28 which, in conjunction with the counter-rotating conical cutter heads 22 and 24, direct the dislodged material toward the opposed ribs 30 and 32 of room 14. Traction to advance the mining machine 18 into the mine face is provided by conventional endless crawler tracks 31 and 33 (FIG. 3) and may also include a driven roller member 34 that is urged against the roof 36 of room 14. With this arrangement, the mining machine 18 is continuously advanced into the mine face 16 and the conical counter-rotating cutter heads 22 and 24 and top cutter 26 dislodge material from the mine face and deposit the dislodged material adjacent the opposed ribs 30 and 32.

A transverse conveyor generally designated by the numberal 38 has a longitudinal dimension substantially equal to the transverse dimension of the room 14 and includes a pair of spiral conveyors 40 and 42 that convey the dislodged material toward the center of the room away from the ribs 30 and 32. The intermediate portion of the spiral conveyor 38 includes a cylindrical turn around means 44 around which the later described flexible belt conveyor is reeved. The mining machine 18 also has a pair of driven pinch rolls 46 and 48 operable to uncoil the upper strand of the flexible belt. An idler roller 50 extends rearwardly from the mining machine 18 and is arranged to engage the upper surface of the flexible belt top strand.

The material dislodged from the mine face 16 is arranged to be conveyed rearwardly to a discharge station generally designated by the numeral 52 in the entry 12 where it is conveyed along the haulage way 12 by a suitable conveying means such as the endless belt conveyor 54. The discharge station includes a support member 56 on which a spindle 58 is rotatably mounted. A drive motor 60 is provided to rotate the spindle 58 in a preselected direction. A second or upper spindle 62 is suitable supported at an elevated location above the discharge station 52 above the lower spindle 58. For convenience and to more clearly illustrate the herein described invention, the support for the upper spindle 62 is omitted. A motor 64 is connected to the upper spindle 62 to rotate the spindle 62 in a given preselected direction.

A first length of flexible belt generally designated by the numeral 66 has a first end portion coiled about the lower spindle 58 and a second end portion coiled about spindle 62. The intermediate portion of the flexible belt 66 is reeved about the turn around device 44 mounted on the mining machine 18 to thus form an upper strand 68 and a lower conveying strand 70. The lower strand 70 is arranged to slide on the floor 7 of the room 14 and the upper strand 68 is arranged to slide on the upper surface of the dislodged material being conveyed by the lower strand 70.

Figure 2:
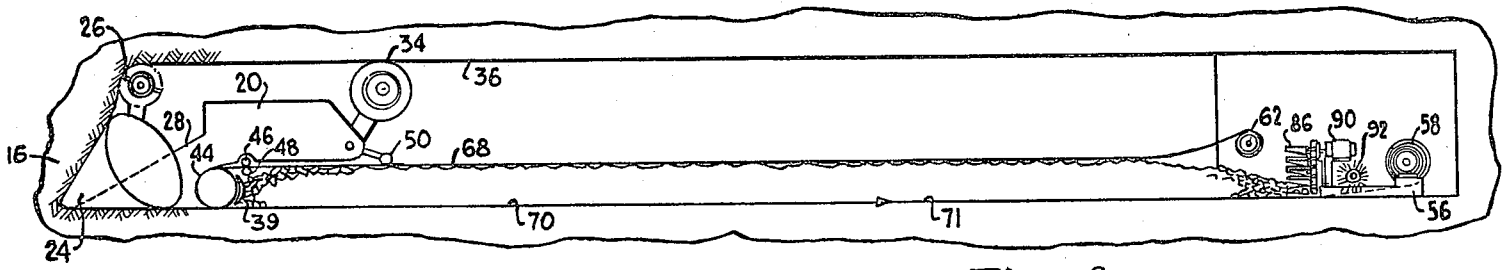
FIG. 2 is a view similar to FIG. 1, illustrating the mining machine at a substantial distance from the discharge station with a substantial portion of the flexible belt uncoiled from the upper spindle.
Figure 1:
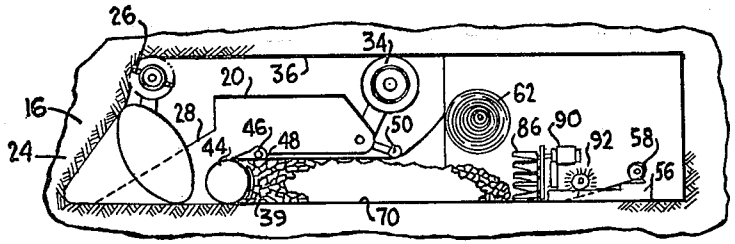
FIG. 1 is a partially schematic view in side elevation of the continuous mining machine having a pair of conical cutter heads and the flexible belt conveyor apparatus associated therewith.

The material dislodged from the mine face 16 by the mining machine conical cutter heads 22 and 24 and the top cutter 26 is displaced laterally against the ribs 30 and 32. As the mining machine advances into the mine face 16 the curved housings 37 and 39, illustrated in section in FIG. 3, extending transversely from the mining machine move into the dislodged coal and the spiral conveyors 40 and 42 mounted on the mining machine 18 adjacent to the curved housings 37 and 39, convey the material transversely along the housings 37 and 39 away from the respective ribs 30 and 32 onto the lower strand 70 of the flexible belt 66. A pair of transversely extending plows 41 and 43, schematically illustrated in FIG. 3 and not shown in FIGS. 1 and 2, are hingedly connected to the mining machine 18 behind the endless crawler tracks 31 and 33 and are arranged to plow spilled dislodged material onto the bottom strand 70 of the flexible belt 66, particularly when the mining machine is withdrawing from the transversely extending room 14. The plows are preferably hinged for vertical movement to compensate for undulations in the main floor. To convey the material to the discharge station 52 the motor 60 associated with the lower spindle 58 is energized and rotates the spindle 58 at a predetermined speed to maintain the lower strand fully loaded with dislodged material. The lower conveying strand 70 moves toward the discharge station 52 and conveys the material away from the mining machine 18 along the length of the room 14 to the discharge station 52. The dislodged material that is spilled from the bottom conveying strand onto the floor 71 forms side boards for the flexible belt bottom strand 70 to retain other conveyed material thereon and increase the conveying capacity of the lower strand 70.

The coiling of the flexible belt 66 on the lower spindle 58 moves successive portions of the lower strand 70 toward the discharge station 52 where the dislodged material is transferred to the fixed conveyor 54 in the entry 12 by means of a transfer device generally designated by the numeral 74.

Figure 4:
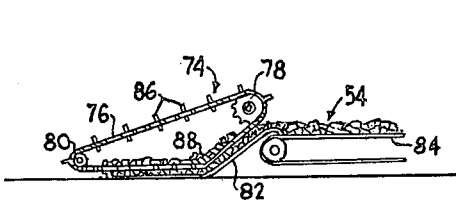
FIG. 4 is a view in section taken along the line IV–IV of FIG. 3, illustrating the manner in which the dislodged material is transferred from the lower conveying strand of the flexible belt onto a fixed conveyor.

As illustrated in FIG. 4, the transfer device 74 includes an endless flexible belt 76 reeved about pulleys 78 and 80. An included fixed blade 82 extends from a location adjacent the edge of the lower strand 70 into overlying relation with the upper endless conveyor reach 84 of the endless conveyor means 54. The flexible belt 76 has a plurality of spaced paddle membes 86 mounted thereon and a gear toothed rolled 88 maintains the paddles 86 in abutting relation with the upper surface of the lower conveyor portion 70 and the upper surface of inclined blade 82. The endless belt 76 is driven by a motor 90 to transfer the dislodged material from the bottom strand 70 upwardly along the inclined blade 82 onto the upper reach 84 of the fixed conveyor means 54. There is also provided a suitable cleaning device 92 that removes the small particles of dislodged material remaining on the upper surface of the lower strand 70 before the lower strand 70 is coiled on the spindle 58.

The upper strand 68 of flexible belt 66 extends between the pair of driven pinch rolls 46 and 48 mounted on the mining machine 18. The pinch rolls 46 and 48 are driven at a preselected speed to pull the top strand 68 into the mining machine from the coil mounted on the upper spindle 62. The pinch rolls 46 and 48 urge the belt around the turn around device 44 and tension the upper strand 68. The pinch rolls 46 and 48 further reduce the tensile stresses on a portion of the flexible belt 66 to permit increased loading on the lower strand 70. The turn around device 44 may be a fixed semicylindrical surface on which the flexible belt slides, or it may be a series of idler pulleys or, where desired, the pulleys may be driven.

Figure 5:
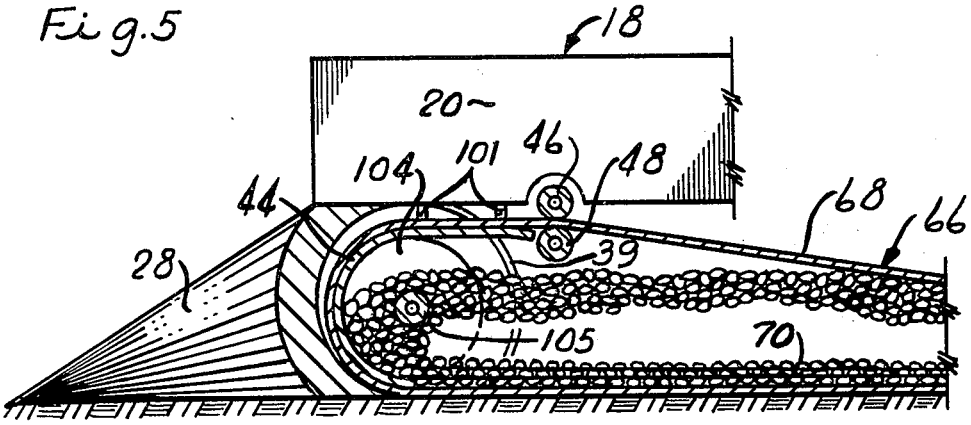
Fig. 5 is a sectional vertical view showing in greater detail the turnaround means and the forwardly extending apron of the mining machine.
Figure 6:
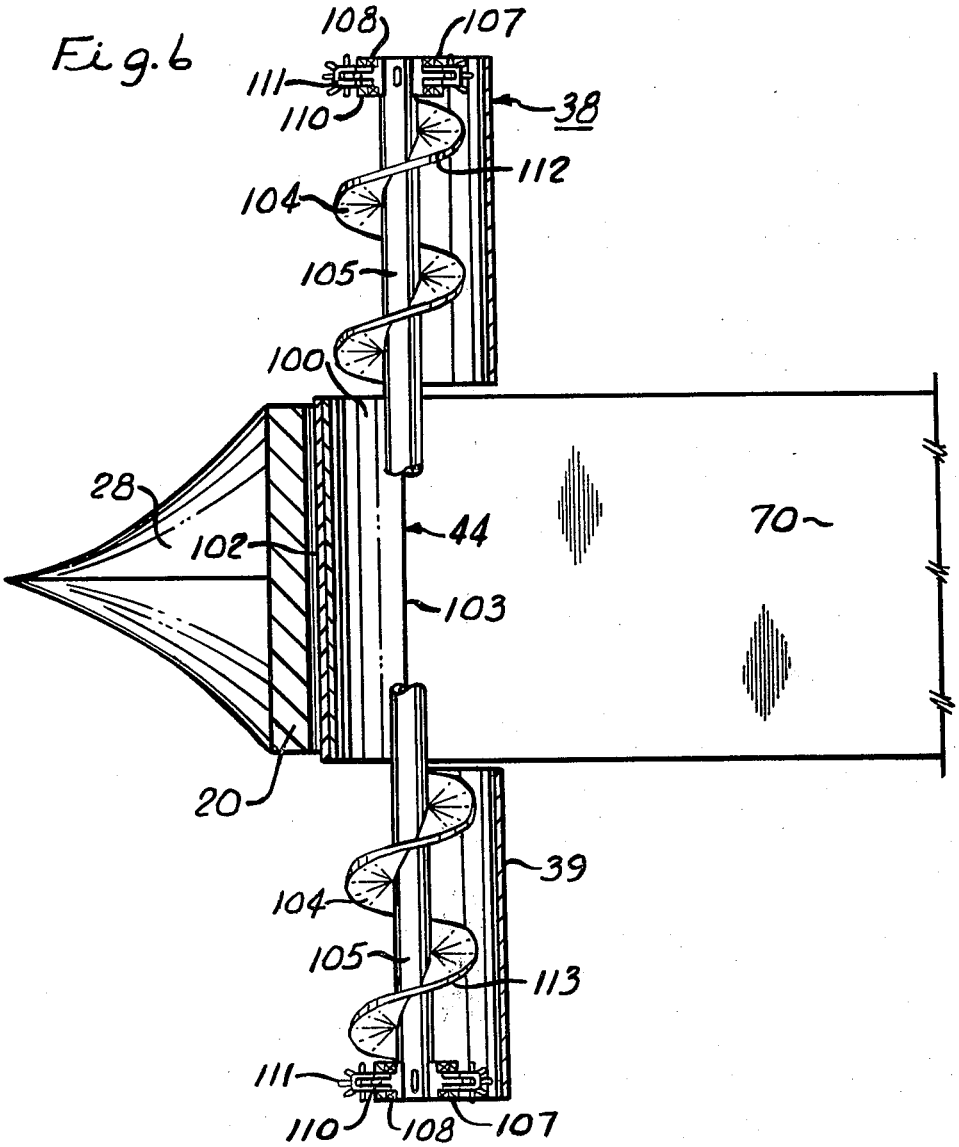
FIG. 6 is a horizontal sectional view showing in greater detail the turnaround means and the spiral conveyor means for conveying dislodged materials to the turnaround means.

Reference is now made particularly to FIGS. 5 and 6, where there is shown in greater detail the turnaround means 44 and the transverse spiral conveyor 38. The turnaround means 44 in essence is an arcuate shaped or substantially semicircular housing 100 attached beneath the frame 20 such as shown at 101 at its outer limits to permit the passage of the flexible belt 66 around its outer surface 102. The belt 66 thus becomes exposed from beneath the lower edge 103 of the turnaround means 44 from which point it forms the lower or load carrying strand 70.

Conveyor 38, as also shown in FIG. 3, is a spiral conveyor having a spiral flight 104 spirally secured along the tubular support member 105. The spiral flight is actually formed in two sections, 112 and 113, one on the right side of the frame 20 and the other on the left side of the frame 20. The central portion 106 of the tubular member 105 is not provided with a spiral flight, as the dislodged material is deposited directly onto the bottom portion of the turnaround means 44 and the load carrying strand 70 as the machine 18 advances into the mine face and the conveyor 38 is rotatably operated.

The conveyor 38 is supported from beneath the frame 20 at its outer ends by means of the supporting struts 107 secured to the frame. The struts 107 are provided with suitable bearings 108 to rotatably support both ends of the conveyor 38. Driving means are provided on frame 20 to drive the sprockets 110 secured to the ends of the tubular member 105 through the means of the drive chains 111. Upon rotation of the spiral conveyor 38 by means of the drive chains 111, the dislodged material deposited adjacent the mine ribs 30 and 20 by the conical cutters will be conveyed inwardly from both sides of the mining machine 18 by means of the two spiral conveyor sections 112 and 113 onto the load carrying strand 70.

In one method of operation after a predetermined length of the flexible belt remains coiled on the upper spindle 62 the mining machine 18 is stopped to permit the material on the upper surface of lower strand 70 to be conveyed to the fixed conveyor 54. When all of the dislodged material is removed from the bottom strand 70 it is preferred that little, if any, of the flexible strand 66 remains coiled on the upper spindle 62. To replace the flexible belt 56 on the upper spindle 62. To replace the flexible belt 56 on the upper spindle 62 the motor 64 is energized to coil the flexible belt 66 on the upper spindle 62 while the belt is uncoiled from the lower spindle 58. After substantially all of the flexible belt is uncoiled from the spindle 58 the mining machine 18 is again energized to dislodge material from the face 16 and the dislodged material is again conveyed transversely by the spiral conveyors 40 and 42 onto the lower strand 70 of flexible belt 66.

In another embodiment where continuous operation is desired without the downtime required for recoiling the belt on the upper spindle 62 a second coil of flexible belt generally designated by the numeral 94 is positioned on the upper spindle 62 when the flexible belt 66 has been uncoiled therefrom. The free end portion of the flexible belt in the coil 94 is spliced to the end portion of flexible belt 66 to provide additional belting for conveying the dislodged material from the mining machine 18 to the discharge station 40. When all of the flexible belt 66 is coiled on the lower spindle 58 the end of flexible belt 66 is disconnected from the end of the flexible belt in coil 94 and the coil of flexible belt 66 is removed from spindle 58 and positioned on spindle 62 when the additional belting is required.

It is preferred that the flexible beltiing be metallic and fabricated from stainless steel or other high tensile strength steel to permit the belt to be subjected to substantial tensile loads, since the length of the conveying reach and the amount of material deposited on the flexible belt is dependent on the tensile strength of the flexible belt.

Although the mining machine 18 and conveyor apparatus for the dislodged material is arranged to be operable without personnel adjacent the mine face, where desired, air ducts or flexible air conduits may be positioned on and supported by the top surface of the flexible belt upper strand 68. The movement of the upper strand 68 in a direction toward the mine face facilitates advancing the air duct with the mining machine so that air may be continuously discharged adjacent the mine face 16.

According to the provisions of the patent statutes, I have explained the principle, preferred construction and mode of operation of my invention and have illustrated and described what I now consider to represent its best embodiments. However, i desire to have it understood that, within the scope of the appended claims, the invention may be practiced otherwise than as specifically illustrated and described.

1. Apparatus for continuously conveying dislodged material to a fixed discharge station comprising, an advanceable conveyor loading frame, a first spindle mounted adjacent to said fixed discharge station, a second spindle mounted adjacent to said fixed discharge station above said first spindle, drive means to selectively rotate at least one of said spindles in a preselected direction, a flexible belt having an end portion connected to said first spindle so that upon rotation of said first spindle in a preselected direction said flexible belt is coiled on said first spindle, said flexible belt having a second end portion coiled on said second spindle so that upon rotation of said first spindle in a preselected direction said flexible belt is uncoiled from said second spindle, a turnaround device mounted on said frame and movable therewith, said flexible belt having an intermediate portion reeved about said turnaround device to form a lower strand and an upper strand, powered conveying means laterally disposed along the sides of said frame adjacent said turnaround device to convey dislodged material transversely onto the upper surface of said lower strand, said material on said lower strand supporting said upper strand and said drive means operable to rotate said first spindle and move said lower strand intermediate portion toward said discharge station and convey said material positioned thereon toward said discharge station.

2. The apparatus of claim 1 including a mining machine to continuously dislodge material for conveying from a mine face and characterized by a pair of counter- rotating conical cutters to dislodge material from the mine face and discharge said dislodged material laterally toward the mine ribs, the adjacent opposed surfaces of said cutters in tangentially parallel vertical planes with their bottom surfaces in a tangential plane parallel with the plane of the mine floor.

3. Apparatus for continuously conveying dislodged material to a fixed discharge station as set forth in claim 1 which includes, tension means mounted on said frame and movable therewith, said tension means operable to exert a tension on said upper strand and uncoil said upper strand from said second spindle.

4. Apparatus for continuously conveying dislodged material to a fixed discharge station as set forth in claim 1 which includes, a pair of pinch rolls mouned on said frame and movable therewith, said pinch rolls operable to exert a pull force on said flexible belt upper strand in a direction away from said second spindle.

5. Apparatus for continuously conveying dislodged material to a fixed discharge station as set forth in claim 1 which includes, a second flexible belt arranged to be positioned as a coil on said second spindle and connected to the end of said first flexible belt to thereby provide a second flexible belt to convey material to said discharge station.

6. The apparatus of claim 1 characterized by a substantially semicircular housing comprising said turnaround means to permit the passage of said belt therearound, a spiral conveyor comprising said conveyor means extending transversely relative to said belt in axial alignment with said turnaround housing and positioned in curved housings to convey said dislodged material transversely toward said turnaround housing to be deposited on said load carrying strand.

7. The apparatus of claim 1 characterized in that said spiral conveyor conists of a right hand spiral section on one side of said frame and a left hand spiral section on the other side of said frame to permit conveying of said dislodged material adjacent either side of said frame into said turnaround housing and onto said load carrying strand.

8. The apparatus of claim 1 characterized by a plow-shaped forwardly extending apron positioned in front of said turnaround means to plow said dislodged materials toward said powered conveying means.

9. The appratus of claim 1 characterized by a cylindrical drive roller disposed transversely above and supported from said frame to engage a mine roof and aid in advancing the frame.

10. The apparatus of claim 1 characterized by a pair of rearwardly facing and transversely extending plows supported at the rearward extent of said frame to direct spilled dislodged material onto said load carrying strand when said frame is being rearwardly withdrawn.

11. Apparatus for continuously transporting dislodged material to a load carrying strand of a flexible conveyor belt comprising an advanceable conveyor loading frame, an arcuate belt turnaround housing mounted underneath said frame and adapted to receive thereearound said conveyor belt to form said load carrying strand in engagement with the mine floor, spiral conveyor means disposed laterally under said frame in axial alignment with said arcuate housing to convey dislodged material adjacent said ribs transversely toward said turnaround means to deposit said dislodged material on said load carrying strand a pair of driven pinch rollers mounted on said frame adjacent said turnaround housing to grip and urge said belt around said housing, and drive means connected to the opposite end of said load carrying strand to move the latter rearwardly away from said machine to convey said dislodged materials to a point for discharge from said strand.

* * * * *

UNITED STATES PATENT OFFICE

CERTIFICATE OF CORRECTION

Patent No. 3,997,216 Dated December 14, 1976

Inventor(s) John D. Russell

It is certified that error appears in the above-identified patent and that said Letters Patent are hereby corrected as shown below:

Col. 1, line 63, erase "lowe" and substitute --lower--

Col. 2, line 10, erase "at" and substitute --as-- line 14, erase "and uncoil on" and substitute --from-- line 30, erase "he" and substitute --the--

Col. 3, line 68, earse "suitable" and substitute --suitably--

Col. 4, line 14, erase "7" and substitute --71--

Col. 5, lines 67 and 68, delete "To replace the flexible belt 56 on the upper spindle 62."

Col. 6, line 1, erase "56" and substitute --66-- line 25, erase "beltiing" and substitute --belting-- line 46, erase "i" and substitute --I--

UNITED STATES PATENT OFFICE

CERTIFICATE OF CORRECTION

Patent No. 3,997,216 Dated December 14, 1976

Inventor(s) John D. Russell

It is certified that error appears in the above-identified patent and that said Letters Patent are hereby corrected as shown below:

Col. 7, line 34, erase "mouned" and substitute --mounted--

Col. 8, line 8, erase "conists" and substitute --consists--

Signed and Sealed this

Twenty-first Day of June 1977

[SEAL]

*Attest:*

RUTH C. MASON
*Attesting Officer*

C. MARSHALL DANN
*Commissioner of Patents and Trademarks*